United States Patent [19]

Jackson

[11] Patent Number: 5,019,334

[45] Date of Patent: May 28, 1991

[54] LOW DENSITY HIGH STRENGTH ALLOYS OF NB-TI-AL FOR USE AT HIGH TEMPERATURES

[75] Inventor: Melvin R. Jackson, Schenectady, N.Y.

[73] Assignee: General Electric Company, Schenectady, N.Y.

[21] Appl. No.: 385,029

[22] Filed: Jul. 25, 1989

Related U.S. Application Data

[63] Continuation of Ser. No. 202,357, Jun. 6, 1988, abandoned.

[51] Int. Cl.[5] ..... C22C 29/00

[52] U.S. Cl. ..... 420/426; 420/417; 420/418

[58] Field of Search ..... 420/426, 417, 418

[56] References Cited

PUBLICATIONS

Prokoshkin et al., Alloys of Niobium, Daniel D. & Co., N.Y. 1966, pp. 136–137.

Lazarev et al., Fiz. Khim Obrab Mater 21(4) 1987.

Huang, T., Acta Metall Sin (China) 21 1985, A287, pp. 83–88, cited in Alloy Index, vol. 13, 1986, p. E666.

Troitskii et al., Sov. Non Ferrous Met. Res. 9 (1981) 500.

*Primary Examiner*—Upendra Roy

*Attorney, Agent, or Firm*—Paul E. Rochford; James C. Davis, Jr.; James Magee, Jr.

[57] ABSTRACT

An alloy is provided for use at high temperature. The alloy is a niobium-titanium base alloy and has the following approximate composition.

| Ingredient | Concentration in atomic percent | |
|---|---|---|
| | From About | To About |
| Nb | balance essentially | |
| Ti | 31 | 48 |
| Al | 8 | 21. |

6 Claims, 4 Drawing Sheets

LOW DENSITY HIGH STRENGTH ALLOYS OF NB-TI-AL FOR USE AT HIGH TEMPERATURES

This application is a continuation of application Ser. No. 202,357, filed June 6, 1988, now abandoned.

The present invention relates generally to alloys which have relatively lower density (5.5–6.75 g/cm$^3$) relative to their strength at high temperatures. More specifically it relates to alloys having a niobium-titanium base and which have a desirable set of properties including high strength at higher temperatures.

BACKGROUND OF THE INVENTION

It is well known in the aircraft engine field that improved thrust-to-weight ratios are a desirable achievement in the fabrication of jet engines. To improve the ratio either the thrust can be increased or the weight of the engines can be reduced. To reduce the weight of the engine either lighter alloys having the same strength must be substituted for presently used alloys or alloys which are basically stronger than those presently employed must be substituted for the presently used alloys.

Improved thrust can also be achieved by operating the engine at higher temperatures. It is known that in general jet engines operate at higher efficiency if they operate at higher temperatures. If the operating temperature of a jet engine can be increased by 100° the efficiency of operation of the engine can be significantly improved. Jet engines last more than 10 years in service. If the fuel consumed by a jet engine is reduced by a significant degree over the 10 or more years of expected life of a jet engine, then there is a cost saving in the operation of the engine which is very substantial and which permits the engine to be formed at higher costs. The higher engine cost is more than offset by the lower costs of operation of the engine.

Generally speaking alloys must be capable of operating at relatively high temperatures to be employed in the hot portion of a jet engine. Up to now the highest temperature of metal parts in a jet engine is about 2200° F. The present invention is directed toward alloy compositions and articles capable of operating at temperature up to 2200° F. but which have substantially reduced weight relative to those presently used in engines.

In determining the value of a weight reduction in improving the thrust-to-weight ratio of a jet engine, consideration must be given as to where the alloy will be employed in a jet engine. If it is employed in the static portions of the engines then the difference in weight of the engine parts which is achieved by substituting the lower weight parts for the heavier weight parts gives a direct indication of the weight reduction.

By low stress as used herein is meant physical force applied to the articles. Thus while the article may be employed at high temperatures and may have a high thermal gradient, extending from one portion of the article to another, there is no high level of physical force applied to or developed in the article as, for example, a high centrifugal force due to rapid rotation of the article.

More particularly the present invention relates to methods for forming parts for aircraft engines for use at high temperatures. It relates, for example, to nozzle guide vanes which are subject to use at high temperatures but which are not subject to high stress as from impact of other articles at the high temperatures. It relates as well to individual articles which are formed.

It is known that many aircraft engine components such as flaps, seals, vanes, and the like must endure very high temperature as the are exposed to very high temperature gases of combustion within the jet engine. Such parts endure some pressure as they are located in regions of the engine where the gases which are undergoing combustion deliver very high levels of heat to surrounding surfaces. Some of the parts, including flaps, seals and vanes, are employed to direct the movement of the gases undergoing combustion within the jet engine.

In the first stage turbine of an aircraft engine, the vanes are the stationary components of a nozzle which guides the hot gases from the combustor against the rotating turbine blades. The rotating turbine blades extract the energy needed to power the aircraft. Since the vanes are immediately behind the combustor, they are exposed to extremely high gas temperatures. Because these gas temperatures are greater than the melting temperature of the vane alloys, the vane must be cooled by lower temperature gases. The pressure differential between the combustion gases on the exterior of the vane and the cooling gases on the interior of the vane will load or stress the wall of the vane. This loading is small but may be great enough to cause creep, or eventually, rupture, of the vane wall. Failure of the vane also may occur due to thermal fatigue cracking. The thin leading and trailing edges of the vane tend to be heated and cooled faster than the central region of the vane as the engine temperature is changed throughout the operating cycle. The central region of the vane will act to constrain the edges, leading eventually to plastic deformation and thermal cracking. Cracking may degrade the cooling efficiency and may allow temperatures locally to rise, leading to accelerated oxidation or, in the extreme, to melting.

Exhaust nozzle components, such as flaps and seals, also are subjected to low mechanical forces, but can experience large thermal strains in the engine environment. These components are located in the after-burner regions of high-performance aircraft engines. When extra thrust is required during operation, fuel is added to the engine exhaust to promote additional burning. Exhaust nozzle components typically fail via a hot-streak-induced thermal fatigue mechanism in the superalloy face sheet. The hot streaks in the exhaust gases cause large thermal gradients in the face sheet; the resulting thermal stresses cause yielding and permanent deformation of the face sheet. The thermally distorted face sheet seals poorly, causing cold air leaks from the higher pressure air outside the nozzle, further intensifying the thermal gradients. The cyclic thermal gradients cause thermal fatigue cracking and ultimately component failure.

While the above components are not subjected to high stress they are, as indicated, subject to high temperature and they also may be nested in the engine structure so that one part must move relative to other parts without interference. Accordingly any distortion of the parts either due to the method of fabrication or in the use and operation of the components is detrimental to the efficient control of movement of the jet of gases through the engine and also of the efficiency of the operation of the engine.

Another problem encountered in the use of such engine components is failure primarily due to thermal fatigue cracking. The cracking can produce the same results as the distortion of the parts and prevent their easy and efficient nesting and movement for control of the dimensions of the gas jet within the engine and the efficient flow of gases through the engine.

It is known that the refractory metals and notably chromium, molybdenum, tungsten, niobium and tantalum have very high melting temperatures and also have low coefficients of thermal expansion. However, these same materials (except for Cr) have just about no resistance to environmental attack at temperatures above 2000° F. Some coatings have been developed for these materials but the components made with the coated metals have had problems due to poor thermal expansion matching of the coating versus the substrate metal and accordingly have been marginally suitable for the severe thermal cycling exposure which is inherent in the components of aircraft jet engines.

However, in dealing with the rotating parts of the engine the significance of weight reduction can be increased particularly where the weight reduction is achieved at the outer rim or outer regions of the rotating parts. One reason for this result is that the rotating parts of a jet engine rotate at very high velocity. In present engines the parts actually rotate at about 12,000 revolutions per minute. When a heavier part is held at the outer edge of a disk the disk itself must be stronger in order to hold the heavier part during its rotation at about 12000 revolutions per minute. A relatively small reduction in the weight of that part can lead in turn to a reduction in the size and strength of the disk which holds the part. This is because the part itself when rotated at 12,000 revolutions per minute develops a much higher centrifugal force than a lighter part. The higher centrifugal force must be opposed by a higher tensile force through the disk. It has been determined that because of this multiplying effect of the weight reductions in the outer portions of the rotary elements, rotor system weight reductions of up to about 60% can be achieved if increased strength and/or reduced density goals of the rotating elements of an engine can be achieved.

BRIEF STATEMENT OF THE INVENTION

It is accordingly one object of the present invention to provide an alloy system which has substantial strength at high temperature relative to its weight.

Another object is to reduce the weight of the rotary elements presently used in jet engines.

Another object is to provide an alloy which can be employed in the rotating parts of jet engines at high temperatures.

Other objects will be in part apparent and in part pointed out in the description which follows.

In one of its broader aspects objects of the present invention can be achieved by forming a niobium-titanium-aluminum alloy containing the following ingredient composition:

| Ingredient | Concentration in atomic % From | To |
|---|---|---|
| Niobium | balance | essentially |
| Titanium | 31 | 48 |
| Aluminum | 8 | 21 |

With respect to the niobium, the term "balance essentially" is used to include, in addition to the niobium in the balance of the alloy, small amounts of impurities and incidental elements, which in character and amount do not adversely affect the advantageous aspects of the alloy.

BRIEF DESCRIPTION OF THE DRAWINGS

The present invention will be understood more clearly by reference to the accompanying figures in which.

DETAILED DESCRIPTION OF THE INVENTION

It is well known that a commercial superconductive alloy contains about 46.5 wt.% of titanium (about 63 atomic % titanium) in a niobium base.

EXAMPLE 1

A sample of this alloy was prepared and tests of its properties were made. The test results are given in Table I below.

TABLE I

| Tensile tests (Argon) | YS | UTS | ε uniform | ε failure | RA |
|---|---|---|---|---|---|
| 70° F. (23° C.) | 91 ksi | 91 ksi | 0.3 | 3 | 5 |
| 1110° F. (600° C.) | 16 | 25 | 4 | 14 | 17 |
| 1650° F. (900° C.) | 9 | 9 | 0.3 | 60 | 61 |
| 2190° F. (1200° C.) | 5 | 5 | 0.1 | 64 | 49 |

The alloy was also tested in rupture at 3 ksi and 2100° F. in an argon atmosphere. The sample was unfailed after 285 hours. This alloy has a nominal density of 6.02 grams per cubic centimeter. However, the strength of this material is quite low in the 1100 to 2000° F. temperature range. Accordingly it is not an attractive alloy for use as an airfoil fabricating material for jet engines.

EXAMPLE 2

An alloy was prepared by arc casting to contain 45 at.% of niobium, 45 at.% of titanium and 10 at.% of aluminum. No heat treatment or mechanical deformation was done to the arc cast metal sample. Test bars were prepared from the as-cast alloy. Tests were run at the temperatures indicated in Table II below and the results obtained are those which are listed in the Table.

TABLE II

| | 45/45/10 | | | | |
|---|---|---|---|---|---|
| | YS | UTS | ε uniform | ε failure | RA |
| 70° F. | 97 | 97 | 0.1 | 33 | 40 |
| 1100° F. | 53 | 56 | 13 | 34 | 54 |

TABLE II-continued

| | 45/45/10 | | | | |
|---|---|---|---|---|---|
| | YS | UTS | ε uniform | ε failure | RA |
| 1650° F. | 18 | 18 | 0.1 | 116 | 92 |
| 2190° F. | 5 | 5 | 0.2 | 143 | 93 |

The density of this alloy was determined to be 6.33 g/cc. It is evident from Table II that there is a substantial improvement in the tensile properties of the specimen prepared to contain the aluminum in addition to the niobium and titanium according to the ratio of 45 niobium, 45 titanium and 10 aluminum when compared to the conventional niobium-titanium alloy of Example 1.

EXAMPLE 3

An alloy was prepared by arc casting to contain 40 percent of niobium, 40 at.% of titanium and 20 at.% of aluminum. Again, no heat treatment or mechanical deformation was accorded the alloy. Test bars were machined from the as-cast alloy and tests were performed using these test bars. The results are given in Table III.

TABLE III

| | 40/40/20 | | | | |
|---|---|---|---|---|---|
| | YS | UTS | ε uniform | ε failure | RA |
| 70° F. | 135 | 135 | 0.2 | 15 | 50 |
| 1100° F. | 89 | 91 | 0.8 | 13 | 14 |
| 1650° F. | 55 | 66 | 1 | 2.3 | 4.4 |
| 2190° F. | 4 | 4 | 0.1 | 120 | 93 |
| | density 5.95 g/cc | | | | |

From the data tabulated in Table III it is evident that the 40/40/20 niobium-titanium-aluminum alloy of this example has yield strength the properties which are improved over those of the 45/45/10 alloy.

Figure 1:
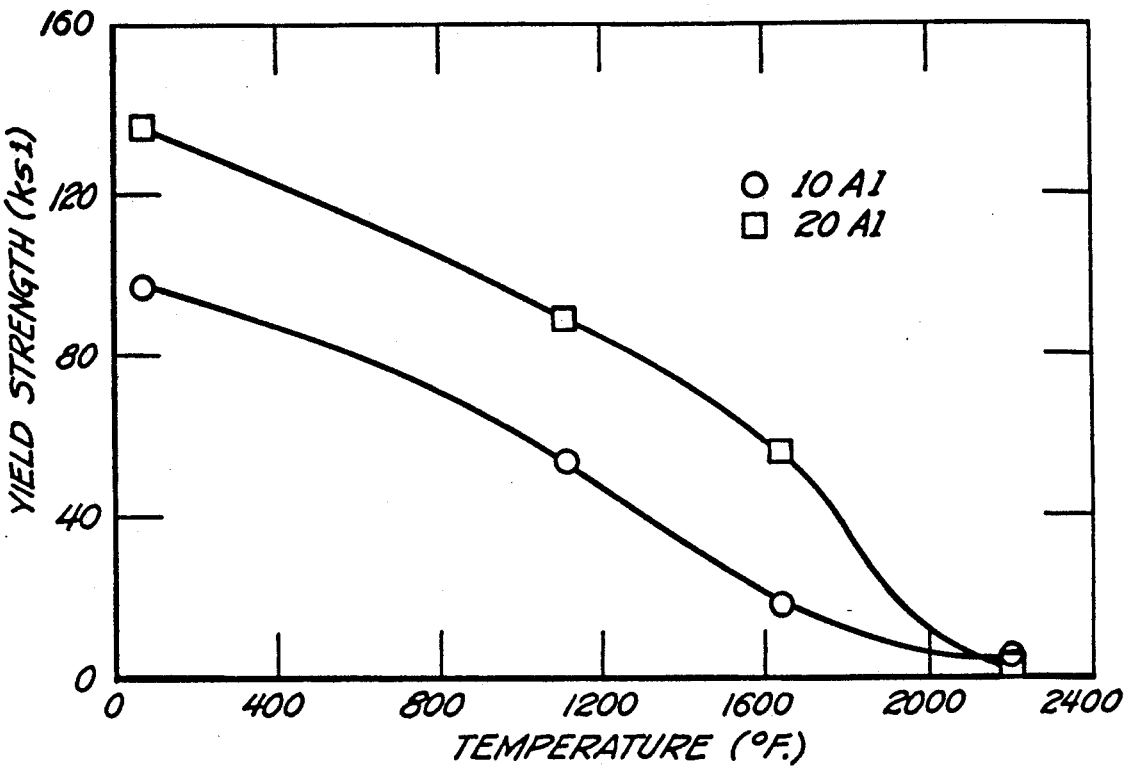
FIG. 1 is a plot of yield strength against temperature for compositions containing 10% and 20% aluminum in a niobium-titanium base.
Figure 2:
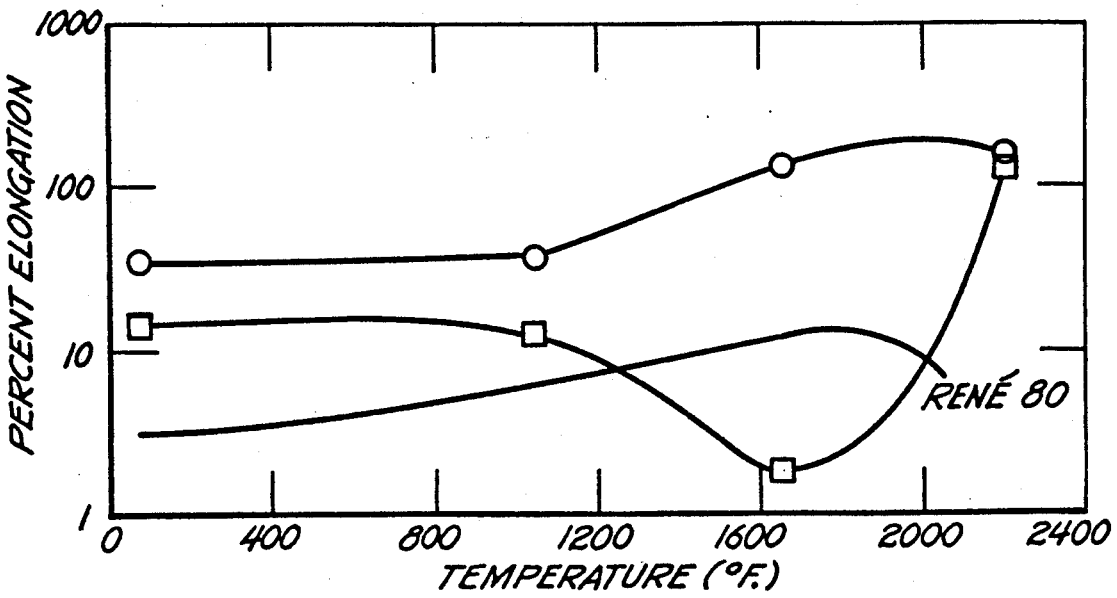
FIG. 2 is a plot of percent elongation against temperature for alloy specimens as plotted in FIG. 1. In this figure the Ni-base superalloy Rene' 80 is also plotted as a comparative to the ductility of the novel samples.

This and the other data from the Examples is plotted in the FIGS. 1 and 2.

Referring now particularly to FIG. 1, this figure contains a plot of the yield strength in ksi against the temperature in degrees Fahrenheit for the two alloys prepared according to Examples 2 and 3 above. It is evident from the figure that the alloys each have very significant strength at room temperature. The strength decreases as the temperature is increased but the alloys retain a measurable strength of about 4 ksi at a temperature of 2190° F. In comparing the alloy containing 10% aluminum to that containing the 20% aluminum, it is evident that the strength of the alloy with 20% aluminum is significantly higher at all temperatures except the 2190° F. test temperature where the strength of the two alloys is about equal.

Referring next to FIG. 2, in this figure the percent elongation or ductility is plotted relative to the temperature in degrees Fahrenheit. Also in this figure a graph of the elongation versus temperature is also plotted for the Ni-base superalloy turbine blade material Rene' 80. It is evident that for the alloy with 10 at.% aluminum the elongation is substantially higher than that of Rene' 80 at all temperatures. Also, the alloy containing 10% aluminum has a higher elongation than the alloy containing 20% aluminum at the three lower temperatures and has a slightly higher elongation than the alloy containing the 20% aluminum at the 2190° F. temperature.

By contrast the alloy containing 20% aluminum has a significant decrease in elongation at the 1650° F. temperature and at this temperature alloy containing 20% aluminum also has a lower ductility than that of Rene' 80.

Rene' 80 is used as a comparison here because it is a commercially available alloy which is well recognized as having very good high temperature properties and particularly high resistance to oxidation at elevated temperatures.

Figure 3:
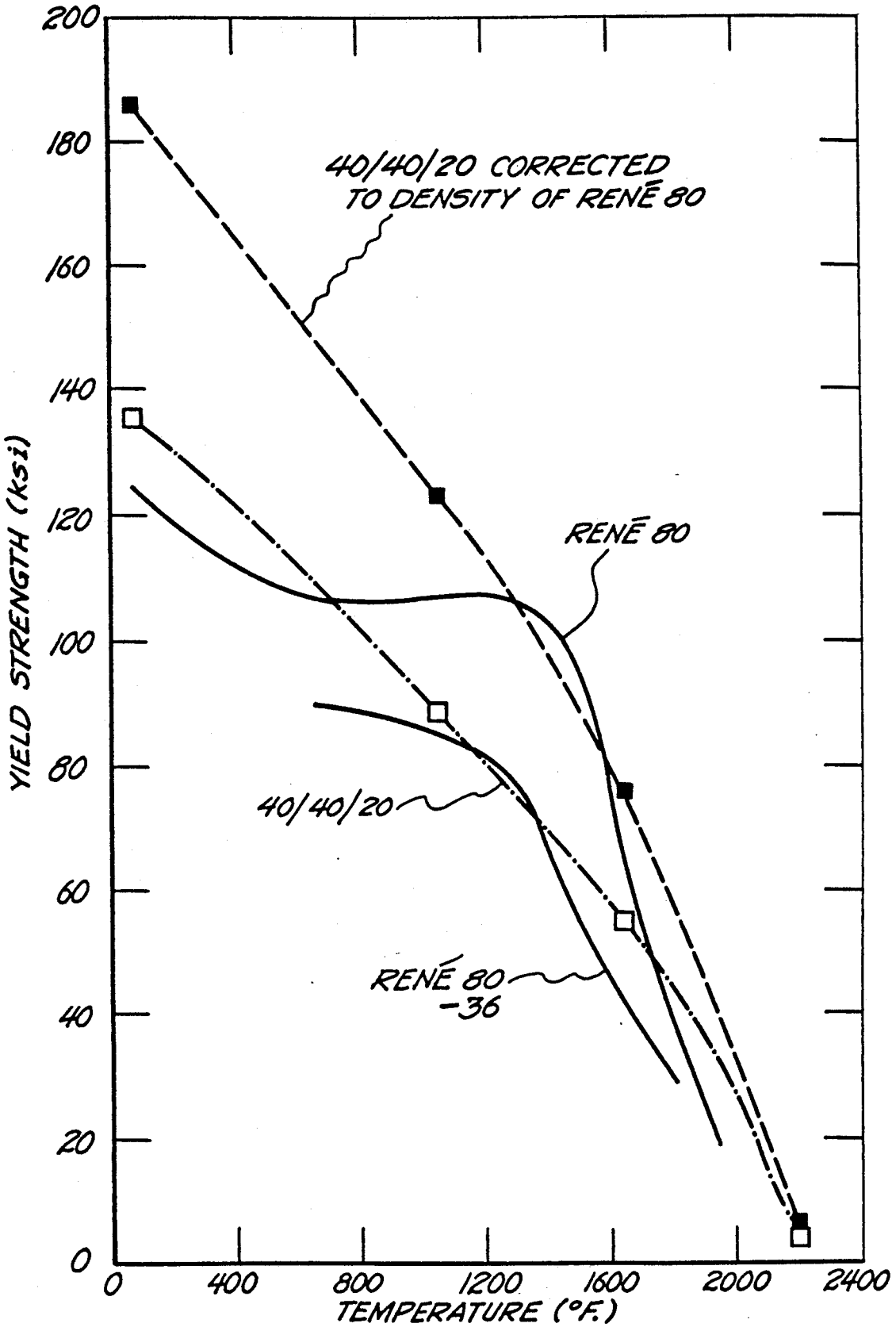
FIG. 3 is a graph of the yield strength plotted as ordinate against temperature plotted as abscissa.

Referring next to FIG. 3, this figure contains graphs of the yield strength in ksi against temperature in degrees Fahrenheit for the 40/40/20 alloy containing the 20% aluminum. There are two graphs one shown with hollow squares and the other with filled-in squares for the alloy containing the 20% aluminum. The lower curve with the filled in squares is based on the actual data points recorded. The upper curve is corrected to show the strength of the alloy containing 20% aluminum relative to the density of Rene' 80. It is well known that the Rene' 80 is a much heavier alloy. The 40/40/20 alloy containing 40% niobium and 40% titanium and 20% aluminum has a density advantage over the Rene' 80 material as it has a lower density. The correction for density was made on the basis of the following equation:

$$\frac{\text{Density } R80}{\text{Density 40/40/20 alloy}} \times \text{strength of alloy.}$$

On the basis of this correction the specific yield strength of the 40/40/20 alloy having a density of about 5.95 g/cc is seen to be stronger than the Rene' 80 alloy.

The Rene' 80 alloy data is based on available data but there is no data available for the strength of this alloy at the 2190° F. temperature and so no data point or curve is shown at this temperature. However, it is believed that the 40/40/20 alloy of the subject invention is at least as strong as the Rene' 80 at this temperature.

In this respect for an airfoil application, for which mechanical loading dominates the application, airfoils of the 40/40/20 alloy of the same wall thickness as current materials would be significantly lighter than current airfoils. Such lighter airfoils would be able to withstand centrifugal self-loading if the specific yield strength comparison is matched by specific creep and rupture properties as well.

EXAMPLES 4–6

Three additional Nb-Ti-Al alloys were prepared by arc casting to contain (a) 33.8 at.% Ti and 8.6 at.% Al; (b) 40.4 at.% Ti and 12.05 at.% Al; and (c) 47 at.% Ti and 15.5 at.% Al. The alloys were of nominal densities of 6.7, 6.2, and 5.9 g/cm$^3$, respectively as is listed in Table IV below as a matter of convenience of reference.

TABLE IV

| | Concentrations of ingredients of alloys in atomic percent | | | |
|---|---|---|---|---|
| | Nb | Ti | Al | Density |
| A | 57.6 | 33.8 | 8.6 | 6.7 |
| B | 47.55 | 40.4 | 12.05 | 6.2 |
| C | 37.5 | 47 | 15.5 | 5.9 |

No heat treatment or mechanical deformation was done to the arc cast metal samples. Test bars were prepared from the as cast alloys. Tests were run at the temperatures indicated in Table V below and the results obtained are those which are listed in the Table.

TABLE V

| | Alloy | YS | UTS | ε uniform | ε failure | RA |
|---|---|---|---|---|---|---|
| 70° F. (23° C.) | a | 116 | 116 | 1.1 | 18 | 42 |
| | b | 114 | 115 | 0.1 | 26 | 37 |
| | c | 113 | 114 | 0.2 | 23 | 44 |
| 1400° F. (760° C.) | a | 61 | 62 | 0.5 | 39 | 67 |
| | b | 55 | 56 | 0.2 | 55 | 62 |
| | c | 75 | 86 | 1.0 | 3 | 2.2 |
| 1795° F. (980° C.) | a | 20 | 20 | 0.2 | 136 | 92 |
| | b | 14 | 14 | 0.1 | 182 | 93 |
| | c | 9 | 9 | 0.2 | 131 | 94 |
| 2190° F. (1200° C.) | a | 10 | 10 | 0.2 | 176 | 91 |
| | b | 8 | 8 | 0.1 | 166 | 88 |
| | c | 5 | 5 | 0.2 | 138 | 95 |

It is evident from Table V that room temperature properties are nearly equivalent for the three materials. At elevated temperatures (1795° F. and 2190° F.) there is a clear strength advantage for the high Nb content material, a, both in terms of absolute strength and in relative specific strength (ratio of strength to density.)

Figure 4:
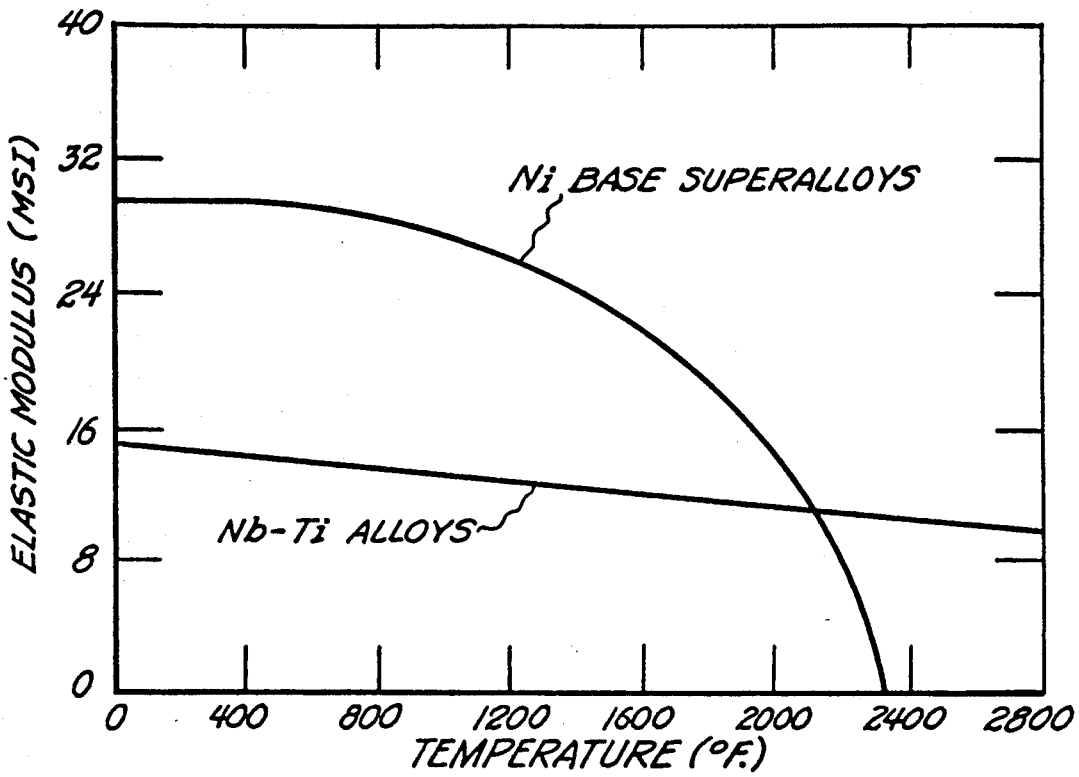
FIG. 4 is a graph of the elastic modulus in $10^6$ psi against temperature in degrees Fahrenheit for the aluminum containing niobium-titanium base alloys as compared to the nickel base superalloys.
Figure 5:
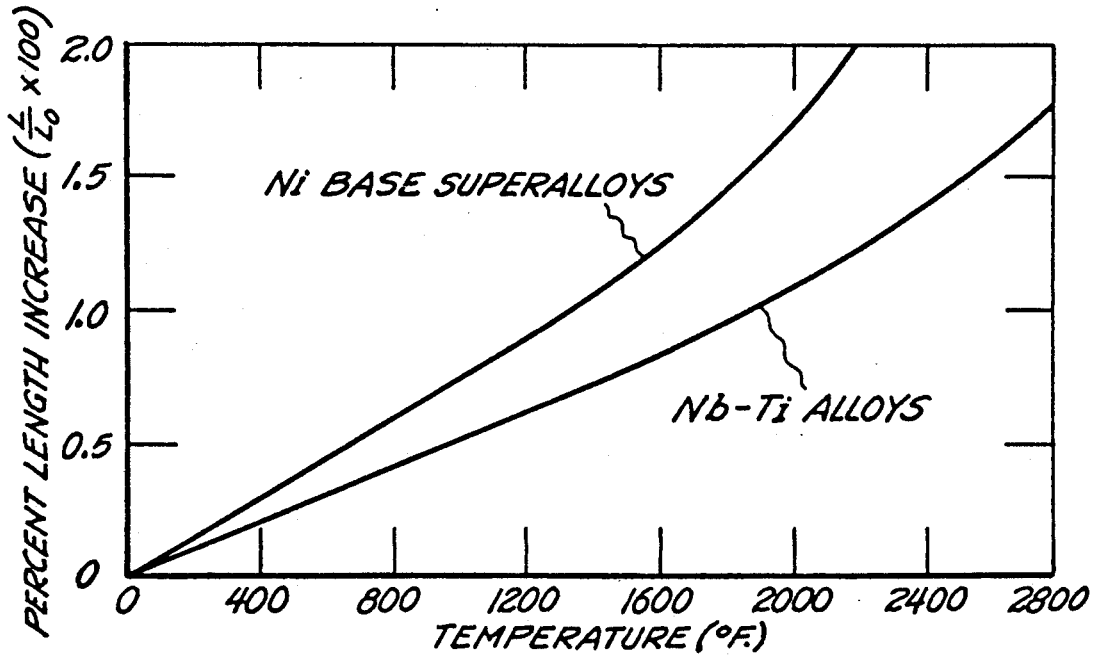
FIG. 5 is a graph in which the percent length increase is plotted against the temperature for both niobium-titanium alloys and for nickel base superalloys.

In general thermal loading plays a major role in airfoil stress development. Thermal fatigue and thermal loading are related to $E\alpha\Delta T$ considerations, where E is elastic modulus, $\alpha$ is thermal expansion coefficient, and $\Delta T$ is the temperature range of the cycle producing thermal loading. In the FIGS. 4 and 5 the elastic modulus and thermal expansion comparisons are made between the nickel base blade alloys and the niobium-titanium base alloys of the subject invention. These plots are approximate because E has not been measured yet at elevated temperature on these specific alloys. However, from the figure the ratio of $E\alpha$ for the nickel base superalloy and for a nickel-titanium base alloy of this invention indicates that thermal stresses will be reduced in the niobium-titanium base alloys to about ⅓ of the level that are present in the nickel base superalloys.

The specific strength and the thermal stress considerations indicate that a major advantage exists for the niobium-titanium base alloys when compared to these considerations as applied to the nickel base superalloys. The airfoil weight reduction cascades back through the disk in the manner described in the background section above to provide a tremendous weight savings. This weight saving has been estimated by designers looking at the opportunity offered by lighter disk alloy materials such as the niobium-titanium base alloys of this invention. The weight saving can amount to about 60% of the disk plus bucket weight as compared to present disk and bucket structures employing the nickel base alloys. This is based on an alloy density of about 5.7 g/cc.

The use of the niobium-titanium base alloys at elevated temperatures of up to about 2200° F. is feasible. However, significant oxidation and embrittlement of these alloys can occur in niobium base alloys. However, the degree of oxidation of the niobium-titanium base alloys of the subject invention are not at all typified by the oxidation behavior of the present niobium base commercial alloys such as Cb-752. Rather and uniquely the degree of oxidation is much lower for the aluminum containing niobium-titanium alloys of the subject invention. It is believed that the oxidation and embrittlement properties of the niobium-titanium-aluminum alloys of the subject invention can be significantly improved by coatings.

The coatings which are suggested for use with the novel alloys of the subject invention include some of the conventional protective coating materials such as the MCrAlY where the M may be nickel, cobalt or iron. However, these materials all have substantially greater thermal expansion than does NbTi. For this reason the FeCrAlY materials look most attractive because of the lower $\alpha$ for body centered cubic FeCrAlY compared to the NiCrAlY or the CoCrAlY. Alternatively, a novel and unique coating based on alloys with a RuCrAl base may be employed as disclosed in copending application Ser. No. 214,078, filed July 1, 1988.

By incorporating an oxide such as alumina or mullite in the FeCrAlY, the expansion matching problem can be decreased.

Figure 6:
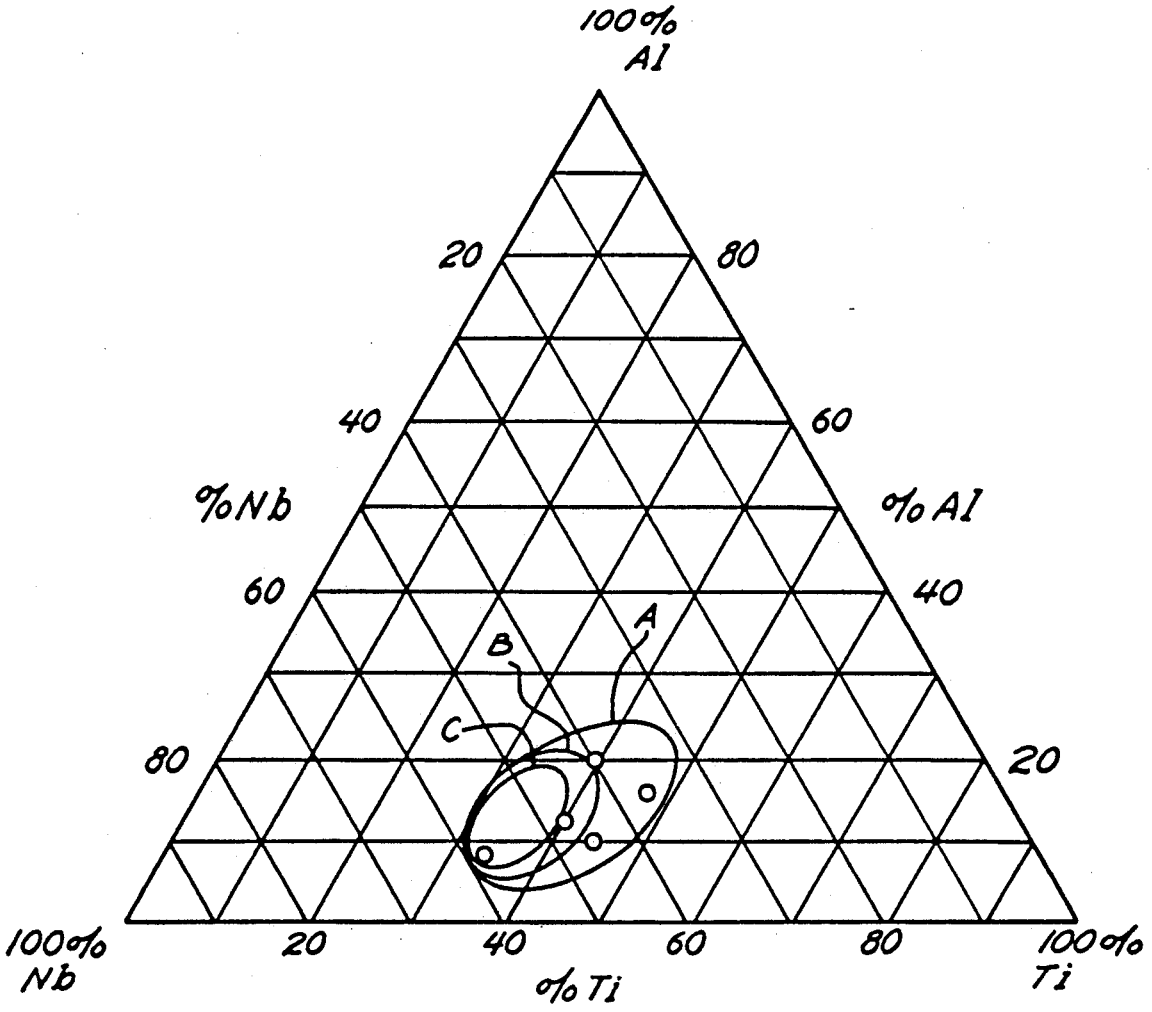
FIG. 6 is a triaxial graph in which the compositions of the present invention are outlined.

FIG. 6 is a triaxial plot in which the titanium aluminum and niobium concentrations are plotted in ways which are deemed to be the most accurate representation of composition relationships but which are not easily recited in simple percentage ranges. In this figure there is an outer curve A enclosing an area of useful concentrations of the three ingredients. There is also an inner curve B enclosing a preferred range of the three ingredients. Further there is an innermost curve C enclosing an area of the most preferred ranges of the three ingredients.

What is claimed is:

1. As a composition of matter, an alloy consisting essentially of niobium, titanium, and aluminum in the approximate concentration in atom percent as follows: titanium 31 to 48, aluminum 8 to 21, the balance being essentially niobium.

2. The alloy of claim 1, in which the concentration of ingredients are as follows: titanium 32 to 38, aluminum 9.5 to 18.5

3. A structural component for use at high strength and high temperature, said component being formed on an alloy consisting essentially of the following ingredients in atom percent: titanium 31 to 48, aluminum 8 to 21, the balance being essentially niobium.

4. As a composition of matter, an alloy consisting essentially of niobium titanium and aluminum in the approximate proportions falling within curve A of FIG. 6.

5. As a composition of matter, an alloy consisting essentially of niobium titanium and aluminum in the approximate proportions falling within curve B of FIG. 6.

6. As a composition of matter, an alloy consisting essentially of niobium titanium and aluminum in the approximate proportions falling within curve C of FIG. 6.

* * * * *